US009501892B2

(12) United States Patent
Englman et al.

(10) Patent No.: US 9,501,892 B2
(45) Date of Patent: Nov. 22, 2016

(54) GAMING MACHINE HAVING AWARD MODIFIER DEPENDENT ON GAME OUTCOME AND METHOD THEREFOR

(75) Inventors: Allon G. Englman, Chicago, IL (US); Jeremy M. Hornik, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 1138 days.

(21) Appl. No.: 11/473,987

(22) Filed: Jun. 23, 2006

(65) Prior Publication Data

US 2007/0298861 A1 Dec. 27, 2007

(51) Int. Cl.
*G07F 17/32* (2006.01)

(52) U.S. Cl.
CPC ..... *G07F 17/32* (2013.01)

(58) Field of Classification Search
CPC ..... G07F 17/3244; G07F 17/34; G07F 17/3267
USPC ..... 463/16–21, 25
See application file for complete search history.

(56) References Cited

U.S. PATENT DOCUMENTS

| | | | | |
|---|---|---|---|---|
| 6,004,207 | A * | 12/1999 | Wilson et al. | 463/20 |
| 6,419,579 | B1 | 7/2002 | Bennett | 463/20 |
| 6,506,114 | B1 * | 1/2003 | Estes et al. | 463/16 |
| 6,558,253 | B1 | 5/2003 | DeSimone et al. | 463/20 |
| 6,561,904 | B2 | 5/2003 | Locke et al. | 463/25 |
| 6,612,927 | B1 * | 9/2003 | Slomiany et al. | 463/16 |
| 6,869,360 | B2 | 3/2005 | Marks et al. | 463/25 |
| 2001/0007828 | A1 * | 7/2001 | Walker et al. | 463/26 |
| 2002/0022514 | A1 * | 2/2002 | Randall et al. | 463/20 |
| 2002/0082074 | A1 | 6/2002 | Bennett | 463/20 |
| 2002/0142821 | A1 * | 10/2002 | Baerlocher | 463/16 |
| 2002/0160827 | A1 * | 10/2002 | Slomiany et al. | 463/16 |
| 2003/0027626 | A1 | 2/2003 | Marks et al. | 463/20 |
| 2003/0054872 | A1 | 3/2003 | Locke et al. | 463/20 |
| 2003/0054875 | A1 | 3/2003 | Marks et al. | 463/20 |
| 2003/0130030 | A1 | 7/2003 | Delott et al. | 463/20 |
| 2003/0162585 | A1 * | 8/2003 | Bigelow, Jr. | G07F 17/32 463/20 |
| 2003/0236115 | A1 | 12/2003 | Chamberlain | 463/16 |
| 2004/0023708 | A1 * | 2/2004 | Kaminkow et al. | 463/16 |
| 2004/0038731 | A1 * | 2/2004 | Englman | 463/25 |
| 2004/0053657 | A1 | 3/2004 | Fiden et al. | 463/16 |
| 2004/0053662 | A1 | 3/2004 | Pacey | 463/16 |
| 2004/0077403 | A1 * | 4/2004 | Maya et al. | 463/20 |
| 2004/0087359 | A1 * | 5/2004 | Cuddy | G07F 17/32 463/20 |

(Continued)

FOREIGN PATENT DOCUMENTS

| | | | |
|---|---|---|---|
| WO | WO 03/083795 | A1 | 10/2003 |
| ZA | 2003/0725 | | 1/2003 |

*Primary Examiner* — Omkar Deodhar
*Assistant Examiner* — Eric M Thomas
(74) *Attorney, Agent, or Firm* — Nixon Peabody LLP

(57) ABSTRACT

A gaming system for conducting a wagering game includes a wager input device and a display for displaying a randomly selected outcome. The randomly selected outcome is selected from a plurality of outcomes including at least one winning outcome. The gaming system further includes a controller operative to (i) display the at least one winning outcome, and (ii) provide an award modifier to the player, wherein the award modifier is dependent on a quantity of symbols which comprises the at least one winning outcome.

20 Claims, 6 Drawing Sheets

(56) References Cited

U.S. PATENT DOCUMENTS

| | | | | |
|---|---|---|---|---|
| 2004/0121838 | A1* | 6/2004 | Hughs-Baird | G07F 17/32 463/25 |
| 2004/0195773 | A1 | 10/2004 | Masci et al. | 273/317 |
| 2004/0242316 | A1* | 12/2004 | Oles et al. | 463/20 |
| 2005/0054412 | A1 | 3/2005 | Gauselmann | 463/16 |
| 2005/0060050 | A1 | 3/2005 | Baerlocher | 700/92 |
| 2005/0096123 | A1 | 5/2005 | Cregan et al. | 463/20 |
| 2005/0130737 | A1 | 6/2005 | Englman et al. | 463/25 |
| 2005/0192072 | A1 | 9/2005 | Fiden | 463/16 |
| 2005/0288093 | A1 | 12/2005 | Englman et al. | 463/20 |
| 2006/0116194 | A1 | 6/2006 | Pacey et al. | 463/20 |
| 2006/0199634 | A1 | 9/2006 | Anderson et al. | 463/20 |

* cited by examiner

GAMING MACHINE HAVING AWARD MODIFIER DEPENDENT ON GAME OUTCOME AND METHOD THEREFOR

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having award modifiers which are dependent on game outcomes.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

Traditionally, gaming machines have awarded bonus awards and/or award modifiers in response to certain triggering events. Some triggering events have included mystery awards, awards based upon certain winning combinations appearing on the gaming machine, and awards in response to accumulation of certain symbols or combinations of symbols on the gaming machine. One problem that exists is that these methods of awarding bonus awards or award modifiers are provided in response to only certain winning outcomes, or only in certain situations. Therefore, a player of such a gaming machine is required to learn which combinations trigger bonus awards or award modifiers, or in the alternative, is unaware of what events trigger such awards. The present invention is directed to solving one or more of these and other problems.

SUMMARY OF THE INVENTION

According to one aspect of the present invention, a gaming system for conducting a wagering game includes a wager input device and a display for displaying a randomly selected outcome. The randomly selected outcome is selected from a plurality of outcomes including at least one winning outcome. The gaming system further includes a controller operative to (i) display the at least one winning outcome, and (ii) provide an award modifier to the player, wherein the award modifier is dependent on a quantity of symbols which comprises the at least one winning outcome.

According to another aspect of the invention, a method of conducting a wagering game on a gaming system comprises receiving a wager from a player and displaying a randomly selected outcome. The randomly selected outcome is selected from a plurality of outcomes including a plurality of first winning outcomes and a plurality a second winning outcomes. The method further comprises providing a first award modifier to the player if one of the first winning outcomes is displayed, and providing a second award modifier to the player if one of the second winning outcomes is displayed.

According to yet another aspect of the invention, a method of providing an award modifier to a player of a gaming system comprises, in response to receiving a wager input from the player, displaying a plurality of symbols arranged in an array. The method further comprises determining if the array contains a winning combination of symbols, and if so, determining the number of symbols comprising the winning combination. The method further comprises providing an award modifier to the player, the award modifier dependent upon the number of symbols comprising the winning combination.

According to yet another aspect of the invention, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
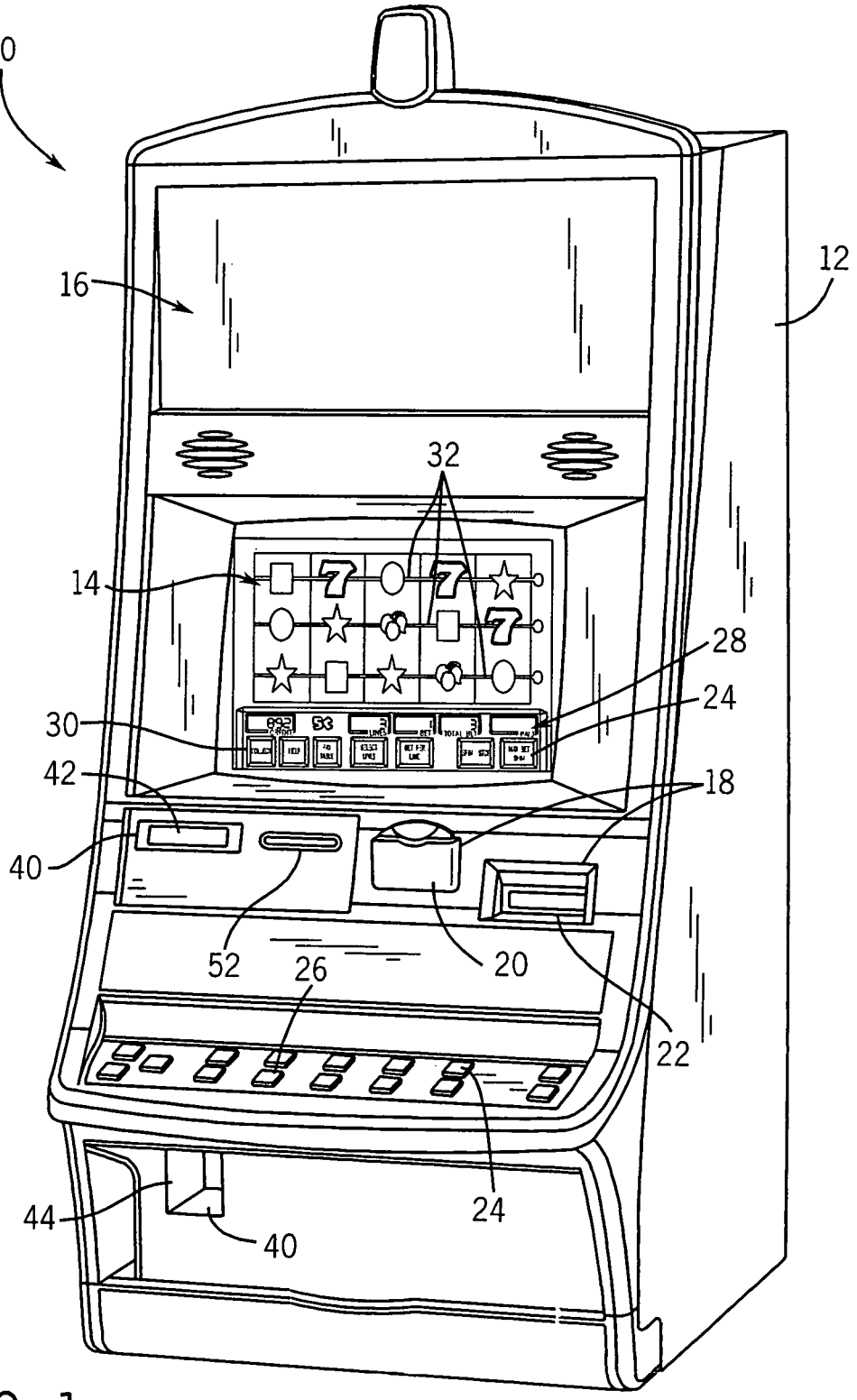
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
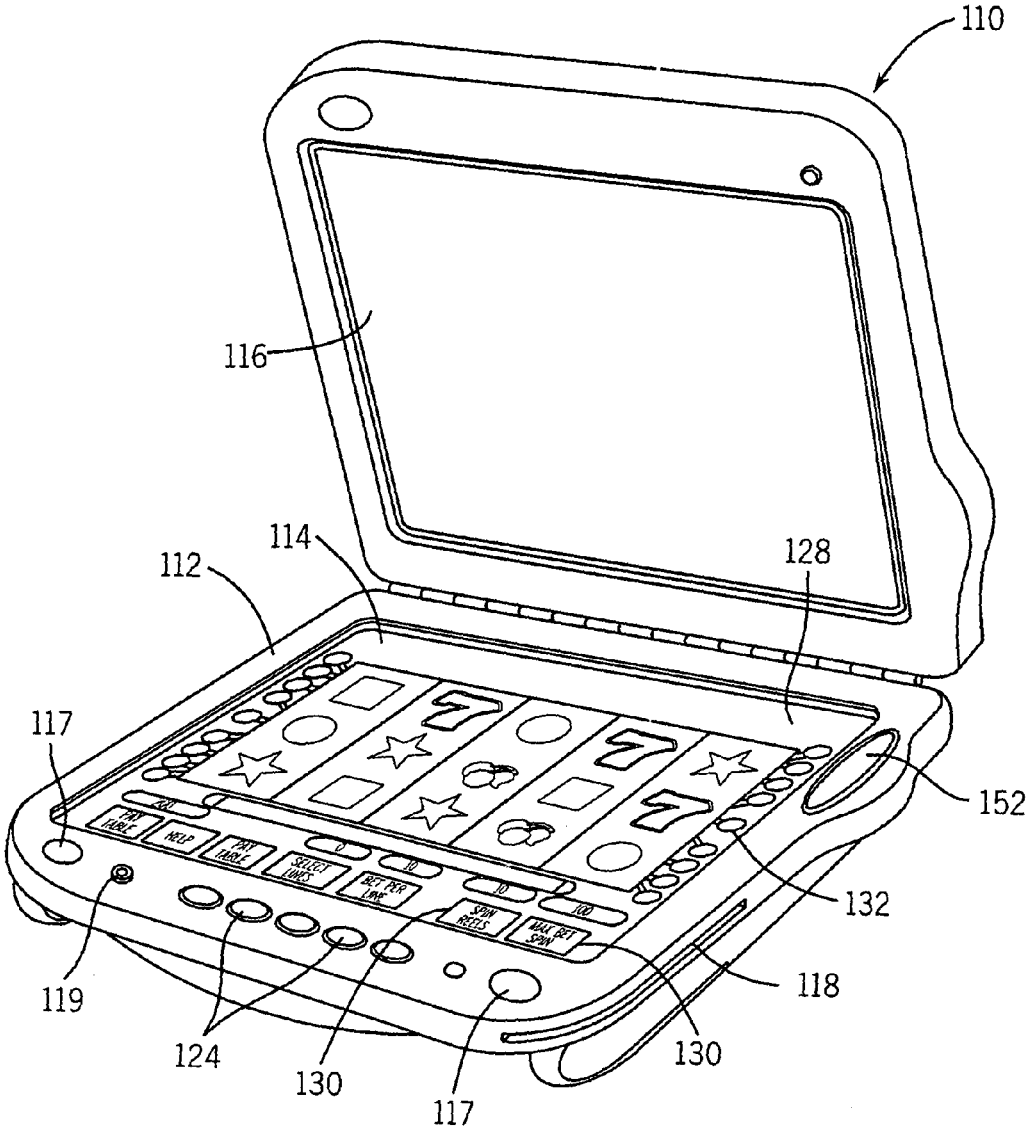
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen mounted to a primary display 114 and/or secondary display 116. In one aspect, the touch screen is matched to a display screen having one or more selectable touch keys 130 selectable by a user's touching of the associated area of the screen using a finger or a tool, such as a stylus pointer. A player enables a desired function either by touching the touch screen at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
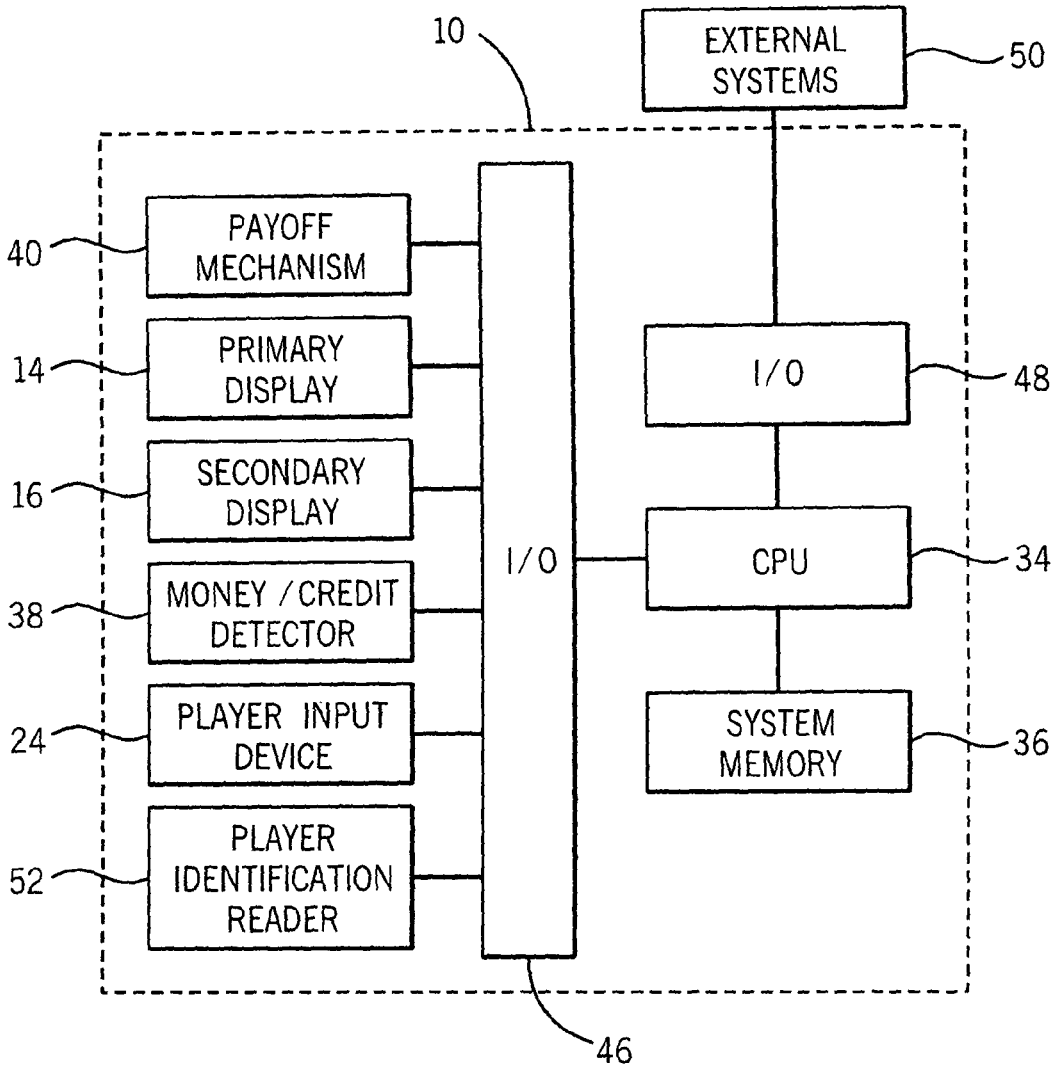
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10, 110 may take on a wide variety of forms such as a free standing machine, a portable or hand-held device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
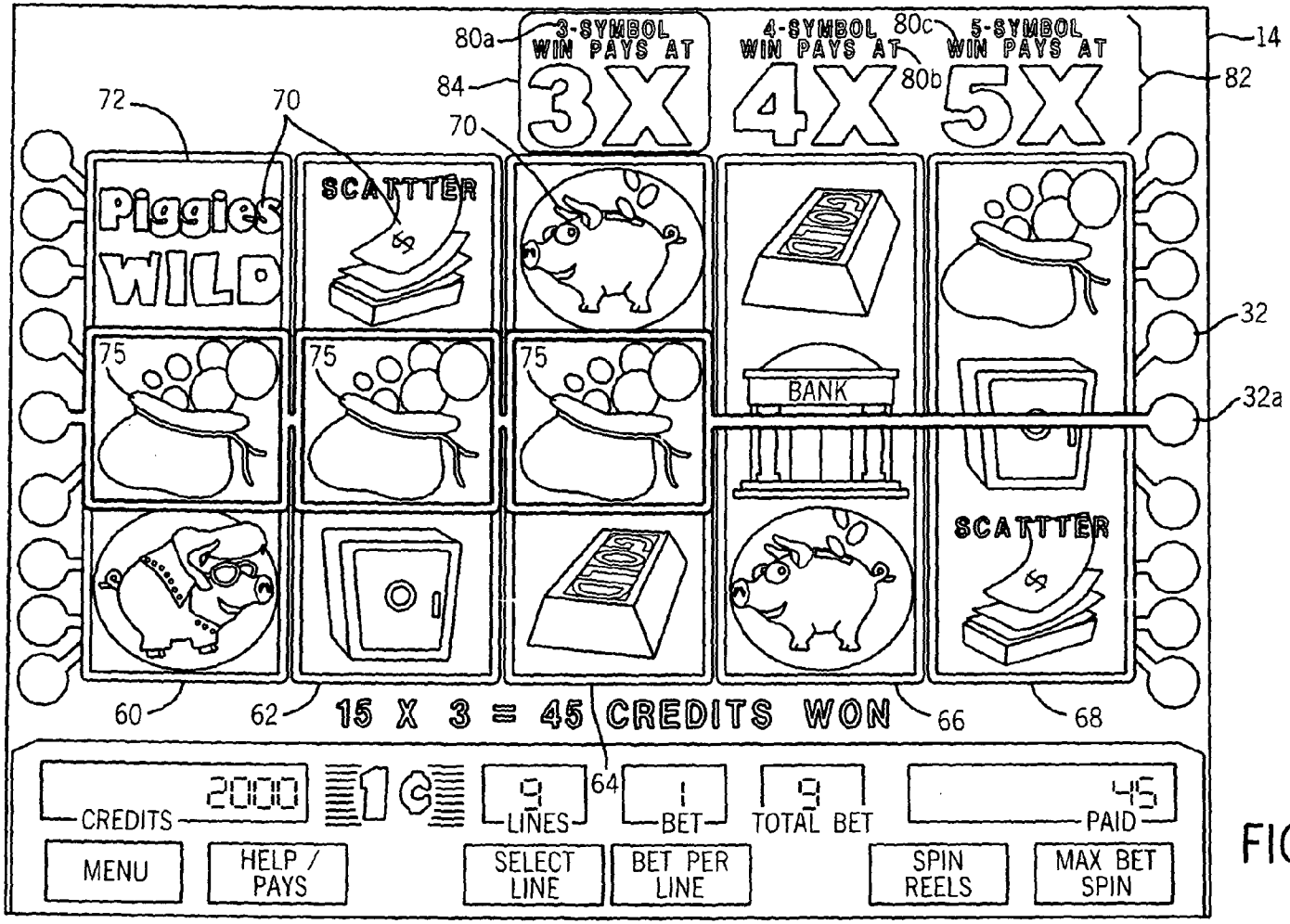
FIG. 3 is a front view of the display of a gaming machine displaying a screen shot depicting one embodiment of the present invention.

Turning now to FIG. 3, the primary display 14 of the gaming machine 10 is depicted. The display 14 includes a plurality of reels 60,62,64,66,68 which display a plurality of symbols 70 arranged in a matrix or array 72. A plurality of paylines 32 extend across the array 72 and pass through one or more symbols 70 on each reel 60,62,64,66,68. In this embodiment, the array 72 is a 3×5 array such that the vertical columns of the array 72 each have three symbols 70 therein, and the horizontal rows of the array 72 each have five symbols therein, for a total of fifteen symbols 70 comprising the array 72. In other embodiments, the array 72 may have greater or fewer symbols 70, different configurations other than rectangular, and may include any number of paylines 32 passing through the array 72. Moreover, in FIG. 3, each of the three symbols 70 in any one of the columns of the array 72 are included on a single reel 60,62,64,66,68, such that when the reels spin, the three symbols 70 in that particular column are located adjacent to one another on the reel 60,62,64,66,68. In other embodiments, however, each symbol 70 in a column of the array 72 may be located on its own individually spinning reel so that each symbol position in the array 72 comprises an independent reel which is operates independently of all other symbol positions in the array 72.

During a play of the game on the gaming machine 10, the reels 60,62,64,66,68 are spun and stopped to display randomly determined outcomes on the display 14 of the gaming machine 10. The randomly determined outcomes comprise random combinations of symbols 70 on the reels 60,62,64,66,68 which are stopped and displayed in the array 72. After the reels 60,62,64,66,68 are stopped, the symbols 70 appearing in the array 72 are evaluated for winning combinations. In this way, the randomly determined outcomes include at least one winning combination of symbols 70 in the array 72. In FIG. 3, the reels 60,62,64,66,68 have stopped to reveal a set of symbols 70 in the array 72 which include three "money bag" symbols 75 across the middle row. In this embodiment, the three "money bag" symbols 75 on an active payline 32*a* comprise a winning combination for which an award is paid. In this case, as seen on the bottom of FIG. 3, the three "money bag" symbols 75 award is paid 15 credits. Although the winning combination in FIG. 3 is required to be a plurality of like symbols landing on an active payline 32, it should be understood that any combination of symbols in the array 72 may be designated as a winning combination for which awards are paid. For example, the winning combination may be a scatter award such that when a predetermined number of like symbols 70 lands anywhere within the array 72, a win is achieved without regard to paylines 32. Moreover, a single symbol 70 landing in the array 72 may be designated as a winning combination.

In FIG. 3, in addition to the award for the winning combination, a bonus award, or award modifier 80 is provided to the player. In this embodiment, the award modifier 80 is a multiplier that is applied to the award for the winning combination. Thus, as seen in FIG. 3, the award modifier 80*a* in this instance is a 3× multiplier, and the player has been awarded a total 45 credits (15 credit winning combination award multiplier by 3× multiplier). The award modifiers 80*a,b,c*, in one embodiment, are displayed on the display 14 via an award modifier display 82. The award modifier display 82 serves to inform the player of the amount and nature of the award modifiers 80*a,b,c*. The award modifier display 82 may optionally include a highlighter 84 to indicate which of the plurality of award modifiers 80*a,b,c* has been awarded on a particular play of the game. Although the award modifier display 82 is included on the primary display 14 in FIG. 3, the award modifier display 82 may be shown in any appropriate place on the gaming machine 10, including the primary and secondary displays 14, 16, or other appropriate display or signage.

Turning back to FIG. 3, the award modifier 80*a* applied to the three "money bag" symbols 70 winning combination is a 3× multiplier. The award modifier 80*a* is provided because the winning combination achieved in the array 72 meets a predetermined criteria, which in this embodiment, is a winning combination having a predetermined number of symbols 70. The award modifier display 82 informs the player that winning combinations comprising three like symbols are awarded a 3× multiplier, winning combinations comprising four like symbols are awarded a 4× multiplier, and winning combinations comprising five like symbols are awarded a 5× multiplier. In this way, the award modifier 80 which is awarded is dependent on the number of symbols 70 in the winning combination. Stated differently, it is the length of the winning combination (i.e. 3 symbols, 4 symbols, 5 symbols, etc) which determines the award modifier 80*a,b,c* which is applied. Therefore, in this embodiment, all three symbol winning combinations are multiplied by an award modifier 80*a* of 3×, regardless of what symbols 70 make up the three symbol winning combination.

Figure 4:
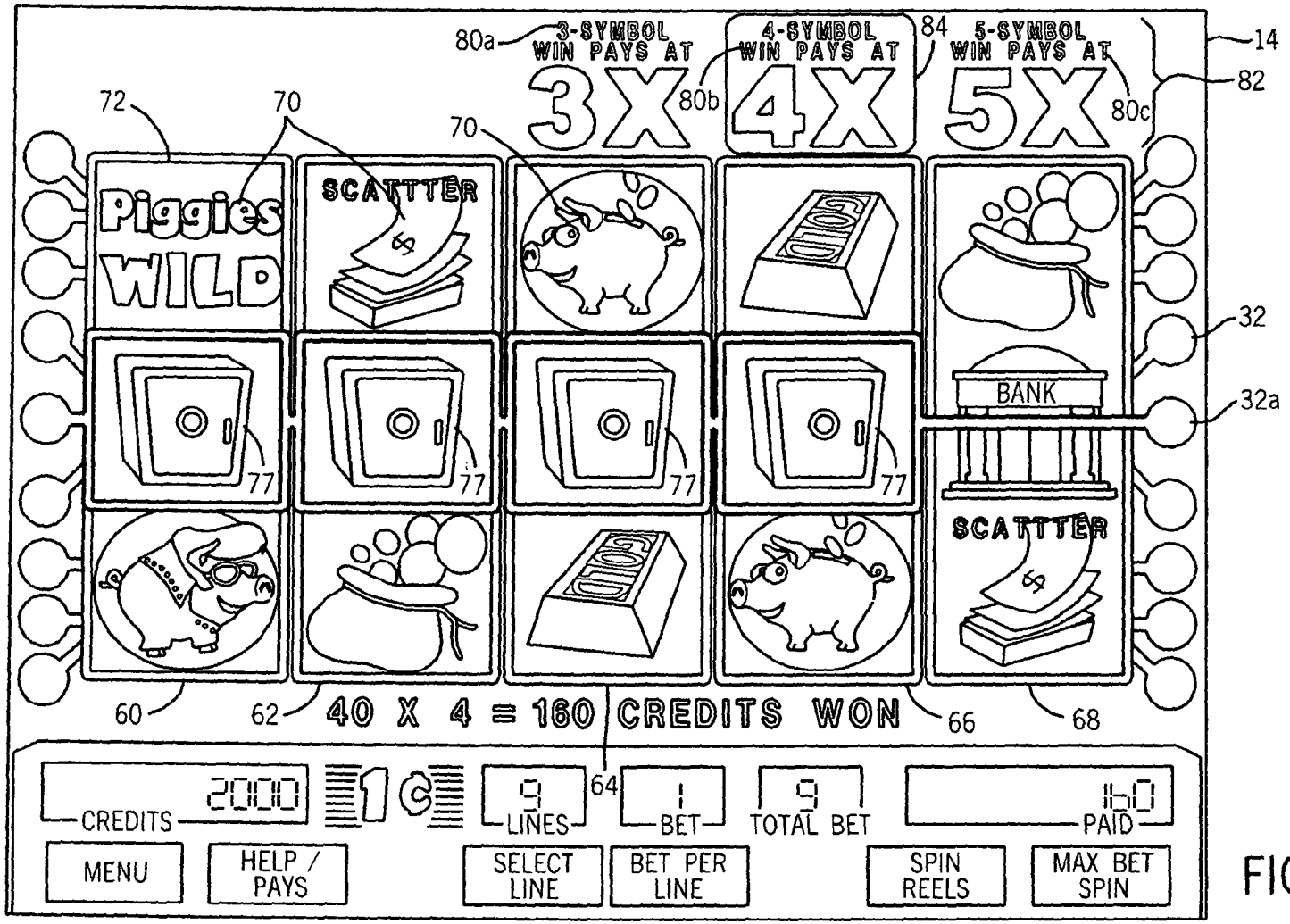
FIG. 4 is a front view of a further screen shot of the gaming machine of FIG. 3.

Turning to FIG. 4, on a subsequent play of the game on the gaming machine 10, the reels 60,62,64,66,68 have stopped to reveal an array 72 having a plurality of symbols 70. Across the middle row, four "safe" symbols 77 have landed on active payline 32*a*, and have resulted in the player receiving an award of 40 credits for the four "safes" symbols 77 combination. In addition, as shown by the award modifier display 82, an award modifier 80*b* of a 4× multiplier has been awarded to the player. The 4× multiplier award modifier 80*b* is applied to the base win of 40 credits for the four "safes" symbols 77 combination, and thus the total award provided to the player is 160 credits, as seen on the display 14 in FIG. 4. Moreover, the award modifier display 82 highlights which of the award modifiers 80*b* is being awarded and applied. In this case, the highlighter 84 comprises a border which is applied around the 4× multiplier award modifier 80*b* which has been achieved. Again, the award modifier 80*b* is provided in response to the winning combination including a predetermined number of symbols (in this case, four symbols 70), and thus being of a predetermined length.

Figure 5:
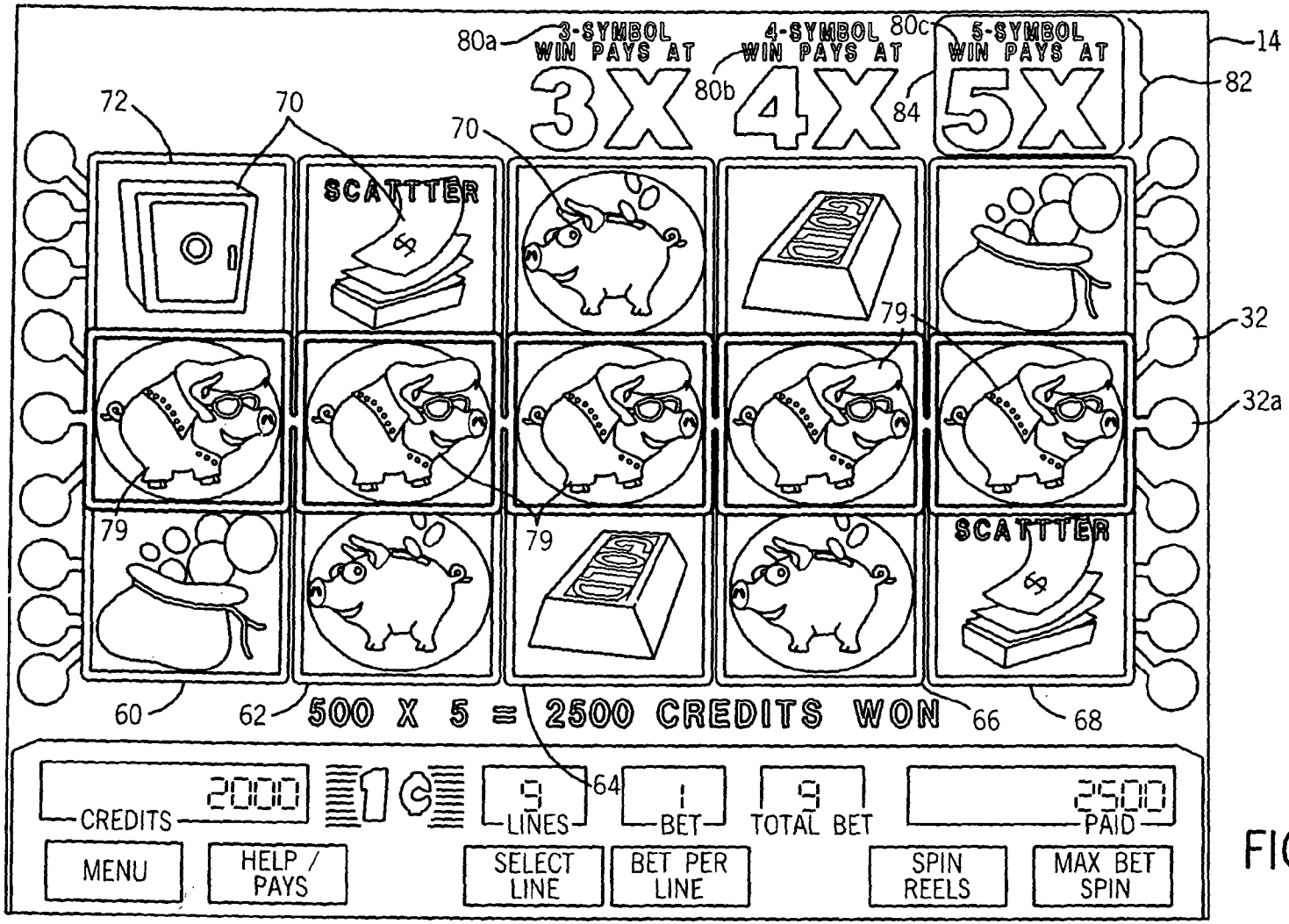
FIG. 5 is a front view of yet another screen shot of the gaming machine of FIG. 3.

In FIG. 5, yet another play of the game on the gaming machine 10 is depicted. The reels 60,62,64,66,68 have stopped and a different array 72 of symbols 70 is displayed on the display 14. On this play of the game, five "Elvis pig" symbols 79 have landed across the middle row on an active payline 32*a*. Thus, the player has been awarded 500 credits for the five "Elvis pig" symbols 79 winning combination. In addition to the base award of 500 credits (which is dependent on both the type of symbol and the number of symbols in the winning combination), the player is awarded an award modifier 80*c*, which in this case is a 5× multiplier. The award modifier 80*c* is awarded based upon the fact that the winning combination comprises five like symbols 70. Thus, the award modifier 80*c* is dependent on the length of the winning combination, or the number of symbols 70 comprising the winning combination. The award modifier display 82 again comprises a highlighter 84 to highlight the provided award modifier 80*c* by placing a border around the modifier 80*c*, so as to signify that it has been awarded to the player. Any variety of highlighter 84 may be used instead of or in addition to the border so as to designate the awarded award modifier 80*c*. The provided award modifier 80*c* of 5× is applied to the base win of 500 credits, such that the total award provided to the player is 2500 credits as seen in FIG. 5.

Although the award modifiers 80*a,b,c* in FIGS. 3-5 are depicted and described as multipliers, any variety of award modifiers or bonus awards could be provided to the player. For example, credit values, free spins, extra selections, or progressive awards are all examples of other bonus awards or award modifiers 80 which could be provided to the player in response to a winning combination comprising a predetermined number of symbols 70. As described herein, the value of the award modifier 80 provided to the player is a function of the quantity of symbols 70 comprising the winning combination of symbols. The award modifier 80 may increase as the number of symbols 70 in the winning combination increases, or it may decrease as the number of symbols 70 in the winning combination increases. Alternatively, the award modifiers 80*a,b,c* may be randomly chosen on various plays of the game, or may be predetermined in other ways.

Each of these embodiments and obvious variations thereof is contemplated as falling within the spirit and scope of the claimed invention, which is set forth in the following claims.

What is claimed is:

1. A gaming system comprising:

a gaming machine primarily dedicated to playing at least one casino wagering game, the gaming machine including an electronic display device and one or more electronic input devices; and one or more controllers configured to:

detect, via at least one of the one or more electronic input devices, a physical item associated with a monetary value that establishes a credit balance;

initiate the casino wagering game in response to an input indicative of a wager covered by the credit balance;

display on the electronic display device a randomly selected outcome selected by at least one of the one or more controllers, the randomly selected outcome selected from a plurality of outcomes including a plurality of first winning outcomes and a plurality of second winning outcomes, each first winning outcome comprising M like symbols, each second winning outcome comprising N like symbols, wherein M and N are not equal;

modify an award associated with a respective one of the plurality of first winning outcomes by a first award modifier common to all of the plurality of first winning outcomes if any one of the first winning outcomes is displayed;

modify an award associated with a respective one of the plurality of second winning outcomes by a second award modifier common to all of the plurality of second winning outcomes if any one of the second winning outcomes is displayed, the first award modifier being different from the second award modifier; and receive, via at least one of the one or more electronic input devices, a cashout input that initiates a payout from the credit balance.

2. The gaming system of claim 1, wherein at least one of the first and second award modifiers is a multiplier.

3. The gaming system of claim 1, wherein at least one of the first and second award modifiers is displayed by an award modifier display.

4. The gaming system of claim 1, wherein the second winning outcomes comprise at least three predetermined like symbols positioned on an active payline on the display.

5. The gaming system of claim 1, wherein at least one of the first and second award modifiers is selected from a plurality of predetermined award modifiers.

6. A method of operating a gaming system, the gaming system including one or more controllers and a gaming machine, the gaming machine primarily dedicated to playing at least one casino wagering game, the gaming machine including an electronic display device and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

displaying on the electronic display device of the gaming machine a randomly selected outcome selected by at least one of the one or more controllers, the randomly selected outcome selected from a plurality of outcomes including a plurality of first winning outcomes and a plurality of second winning outcomes, wherein each first winning outcome comprises M like symbols, each second winning outcome comprises N like symbols, wherein M and N are not equal;

modifying, by at least one of the one or more controllers, an award associated with a respective one of the plurality of first winning outcomes by a first award modifier common to all of the plurality of first winning outcomes if any one of the first winning outcomes is displayed; and modifying, by at least one of the one or more controllers, an award associated with a respective one of the plurality of second winning outcomes by a second award modifier common to all of the plurality of second winning outcomes if any one of the second winning outcomes is displayed, the first award modifier being different from the second award modifier; and receiving, via at least one of the one or more electronic input devices, a cashout input that initiates a payout from the credit balance.

7. The method of claim 6, wherein N is greater than M, and wherein the second award modifier is greater than the first award modifier.

8. The method of claim 6, wherein the first and second award modifiers are multipliers.

9. The method of claim 6, wherein a first one of the first winning outcomes comprises a predetermined number of a first type of symbol and a second one of the first winning outcomes comprises the predetermined number of a second type of symbol.

10. The method of claim 9, wherein the predetermined number is 3, 4, or 5.

11. A method of operating a gaming system that provides an award modifier to a player of gaming system, the gaming system including one or more controllers and a gaming machine, the gaming machine primarily dedicated to playing at least one casino wagering game, the gaming machine including an electronic display device and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

displaying on the electronic display device of the gaming machine a plurality of symbols arranged in an array;

using at least one of the one or more controllers, determining if the displayed array of symbols contains a winning combination of symbols, and if so, determining the number of like symbols comprising the winning combination;

using at least one of the one or more controllers, determining an award modifier from a plurality of different award modifiers based solely upon the determined number of like symbols comprising the winning combination;

modifying an award associated with the winning combination, using at least one of the one or more controllers, of symbols by the award modifier; and receiving, via at least one of the one or more electronic input devices, a cashout input that initiates a payout from the credit balance.

12. The method of claim 11, wherein the award modifier is a multiplier.

13. The method of claim 11, wherein the award modifier increases as the number of symbols increase.

14. The method of claim 11, wherein the symbols in the winning combination are arranged along an active payline extending through the array.

15. The method of claim 11, wherein the award modifier is independent of the type of symbols comprising the winning combination.

16. A non-transitory computer readable storage medium encoded with instructions for directing a gaming system to perform the method of claim 6.

17. A non-transitory computer readable storage medium encoded with instructions for directing a gaming system to perform the method of claim 11.

18. The gaming system of claim 1, further including a random element generator configured to generated one or more random elements, the winning outcomes being randomly selected based, at least in part, on the one or more random elements.

19. The gaming system of claim 18, wherein the random element generator and at least one of the one or more controllers reside within a gaming cabinet of the gaming machine.

20. The gaming system of claim 1, wherein the physical item is selected from a group consisting of a currency bill, a coin, a ticket, a coupon, a card, and a computer-readable storage medium.

* * * * *